US008657028B2

(12) United States Patent
Stoner et al.

(10) Patent No.: US 8,657,028 B2
(45) Date of Patent: Feb. 25, 2014

(54) IMPACT HAMMER

(76) Inventors: Raymond Stoner, Yuba City, CA (US); Christopher John Galloway, Davis, CA (US)

( * ) Notice: Subject to any disclaimer, the term of this patent is extended or adjusted under 35 U.S.C. 154(b) by 240 days.

(21) Appl. No.: 13/223,009

(22) Filed: Aug. 31, 2011

(65) Prior Publication Data

US 2013/0048326 A1 Feb. 28, 2013

(51) Int. Cl.
*B25D 9/04* (2006.01)

(52) U.S. Cl.
USPC ..... 173/133; 173/210

(58) Field of Classification Search
USPC ..... 173/133, 210, 202, 204, 203, 90, 124
See application file for complete search history.

(56) References Cited

U.S. PATENT DOCUMENTS 2,317,158 A * 4/1943 Westover ..... 74/55
6,223,834 B1 * 5/2001 Takamura et al. ..... 173/93.5
6,523,622 B1 * 2/2003 Berger et al. ..... 173/212
2006/0237206 A1 * 10/2006 Schamberger et al. ..... 173/201
2010/0252289 A1 * 10/2010 Aoki ..... 173/103

* cited by examiner

*Primary Examiner* — Michelle Lopez
*Assistant Examiner* — Nathaniel Chukwurah
(74) *Attorney, Agent, or Firm* — Carr & Ferrell LLP

(57) ABSTRACT

A hydraulic, pneumatic, or electric tool may include a spindle that is adapted for rotational movement. A swing arm may be coupled to the spindle such that the rotational motion of the spindle is transferred to the swing arm. The swing arm may make contact with an anvil such that the rotational motion of the swing arm causes the anvil to move along a linear path. A piston may be operatively coupled to the anvil to follow the linear movement of the anvil. The piston may be adapted to interact with an energy storage medium when the swing arm moves the anvil in the first direction, causing energy to be stored. As the swing arm continues to rotate, the swing arm may lose contact with the anvil, thus allowing the energy storage medium to urge the piston and the anvil in a second direction opposite the first direction.

20 Claims, 8 Drawing Sheets

IMPACT HAMMER

FIELD OF THE INVENTION

The present invention is generally directed to pneumatic, hydraulic, and electric driven impact tools, and is more specifically directed to an energy saving impact hammer.

BACKGROUND

A wide variety of pneumatic, hydraulic, and electric driven impact tools are used throughout manufacturing and construction. Most of these tools can trace their origins back to the invention of the jackhammer in the late 1800's and operate under the principle of storing energy via a compressed gas or utilizing a pressurized fluid, then releasing the stored energy to perform useful work. Common tools include jackhammers, pneumatic impact wrenches, pneumatic rock drills, post drivers, nail guns, and pile driving equipment. Due to the structural requirements of utilizing high pressure fluids or large volumes of compressed air, these tools are generally heavy, bulky, relatively expensive, and require large quantities of energy to operate.

Hydraulic breakers of various sizes work on the principle of moving a piston against a reactive force (commonly provided by a spring) and then releasing the piston to facilitate an impact. With this design, oil or other fluids may be used to stroke a hydraulic cylinder which is incorporated as part of the piston. The hydraulic fluid lifts the piston thereby compressing a gaseous spring. The oil is then released, and the piston is propelled to an impact. A drawback of this design is that a valve must be actuated and the oil evacuated with each stroke or impact of the piston, resulting in a parasitic load that consumes a portion of the stored energy and reduces the efficiency of the jackhammer. Additionally, as the piston nears the end of its stroke, it is decelerated as the oil cushions the movement and the valve begins to actuate for the next lift cycle, thus diminishing the impact of the piston. To counter these losses, higher reactive forces or hydraulic pressures may be used, which requires greater energy input, structurally stronger equipment, and increased maintenance, thereby resulting in a shorter tool life.

Electric breakers and gasoline-powered breakers (petrol breakers) work on the reciprocating principle. A cylinder is moved up and down rapidly by means of a crankshaft and rod. A snug fitting piston is placed inside the cylinder and as the cylinder is moved upward, a vacuum is created that lifts the piston. As the cylinder is then forced downward via the crankshaft and rod, the piston is forced downward as well. Once the cylinder passes half stroke (the point of maximum acceleration), it begins to slow. The piston continues in a free body motion until the point of impact. Once the cylinder begins to slow, the piston is no longer accelerated, resulting in a limited impact force.

Pneumatic hammers of all sizes employ a piston within a cylinder. A pulse of compressed air pushes the piston upward until the piston contacts a valve. The valve then opens, allowing a large pulse of compressed air to accelerate the piston downward producing an impact on a work tool. One drawback of pneumatic hammers is the requirement for large quantities of compressed air, which requires energy intensive compressors. A second drawback of pneumatic hammers is the noise pollution associated with releasing compressed air and the running of large compressors.

SUMMARY

Various embodiments of the present application are directed to pneumatic, hydraulic, and electric tools, specifically an impact hammer. An exemplary impact hammer includes a spindle that is adapted for rotational movement. A swing arm is coupled to the spindle such that the rotational motion of the spindle is transferred to the swing arm. The swing arm makes contact with a contact surface of an anvil such that the rotational motion of the swing arm causes the anvil to move in a first direction along a linear path. A piston is operatively coupled to the anvil to follow the linear movement of the anvil. The piston may be adapted to interact with an energy storage medium when the swing arm moves the anvil in the first direction, thereby causing energy to be stored in the energy storage medium. As the swing arm continues to rotate, the swing arm may lose contact with the contact surface, thus allowing the energy storage medium to urge the cylinder and the anvil in a second direction opposite the first direction.

DETAILED DESCRIPTION

The present application is directed to pneumatic, hydraulic, and electric tools, specifically an impact hammer. Various embodiments comprise a spindle that is adapted for rotational movement. A swing arm is coupled to the spindle such that the rotational motion of the spindle is transferred to the swing arm. The swing arm may make contact with a contact surface of an anvil such that the rotational motion of the swing arm causes the anvil to move in a first direction along a linear path. A piston is operatively coupled to the anvil to follow the linear movement of the anvil. The piston is adapted to interact with an energy storage medium when the swing arm moves the anvil in the first direction, thereby causing energy to be stored in the energy storage medium. As the swing arm continues to rotate, the swing arm may lose contact with the contact surface, thus allowing the energy storage medium to urge the cylinder and the anvil in a second direction opposite the first direction.

Figure 1A:
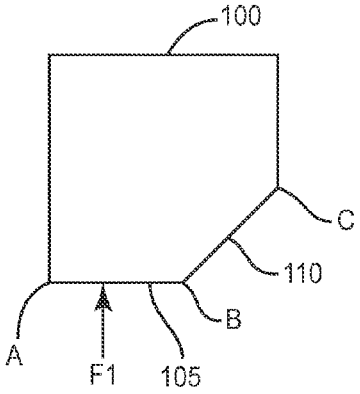
FIGS. 1A through 1C are schematic diagrams of an exemplary anvil.
Figure 1B:
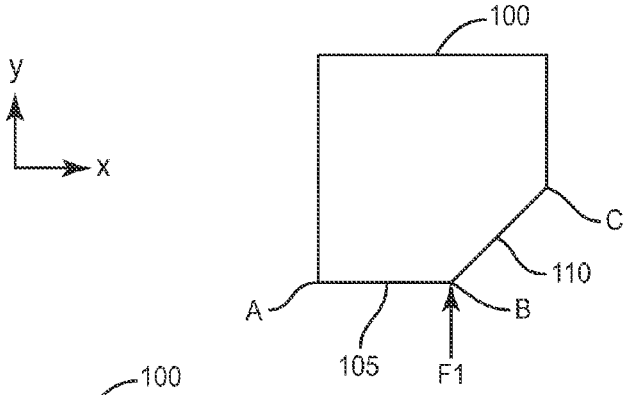
Figure 1C:
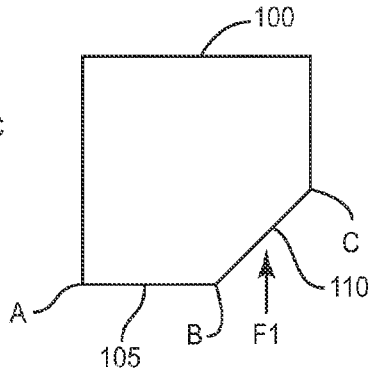

FIGS. 1A through 1C schematically illustrate the operation of various embodiments of an impact hammer. In FIG. 1A, an anvil 100 comprises a contact surface 105 and a ramp off surface 110. Point A represents a point on the contact surface 105 farthest away from the ramp off surface 110, and point B represents a point on the contact surface 105 in closest proximity to the ramp off surface 110. The ramp off surface 110 may be oriented at an angle $\alpha$ (see FIG. 6) with respect to the contact surface 105. A motive force F1 may act upon the contact surface 105, causing the anvil 100 to move in the positive y-direction as indicated in FIG. 1A. The force F1 may also be free to move laterally in the positive x-direction as indicated in FIG. 1A.

In FIG. 1B, the force F1 has caused the anvil 100 to move in the positive y-direction in relation to the position of the anvil 100 in FIG. 1A. In addition, the force F1 has moved across the contact surface 105 away from point A into proximity with point B. As the force F1 reaches point B, the anvil 100 has reached a maximum distance traveled in the positive y-direction. In various embodiments, the force F1 may also be restrained from acting upon the anvil 100 any further in the positive y-direction than as illustrated in FIG. 1B.

As the force F1 moves further in the positive x-direction and passes beyond point B as illustrated in FIG. 1C, the force F1 may lose contact with the contact surface 105 because the angle $\alpha$ of the ramp off surface 110 positions the ramp off surface 110 beyond the reach of the force F1 in the positive y-direction. Thus, once the force F1 moves beyond point B in the positive x-direction, the anvil 100 is free to now move in the negative x-direction back to its starting position as indicated in FIG. 1A. In various embodiments, the force F1 may continue to move in the positive x-direction or move in the negative y-direction, or both, at a speed great enough to avoid contact with the ramp off surface 110 as point C approaches the force F1. In various other embodiments, the ramp off surface 110 may contact the force F1 as the anvil 100 moves in the negative x-direction.

FIGS. 2A through 2E further illustrate a cycle of operation of various embodiments in which a swing arm 205 operatively coupled to a spindle 200 imparts the force F1 on the anvil 100. In the embodiments of FIGS. 2A through 2E, the anvil 100 may be operatively attached to a piston 210. At least a portion of the anvil 100, piston 210, spindle 200, and swing arm 205 may be positioned within a housing 215. The housing 215 acts to restrict movement of the anvil 100 and piston 210 in the upward and downward directions (as depicted in FIGS. 2A through 2E, "upward" is understood to mean towards the top of the figure, and "downward" is understood to mean towards the bottom of the figure). The housing 215 may contain a chamber 225 to contain an energy storage medium, the function of which is explained in detail below. The housing 215 may further incorporate at least a portion of a work tool 230 upon which the anvil 100 may act.

Figure 2C:
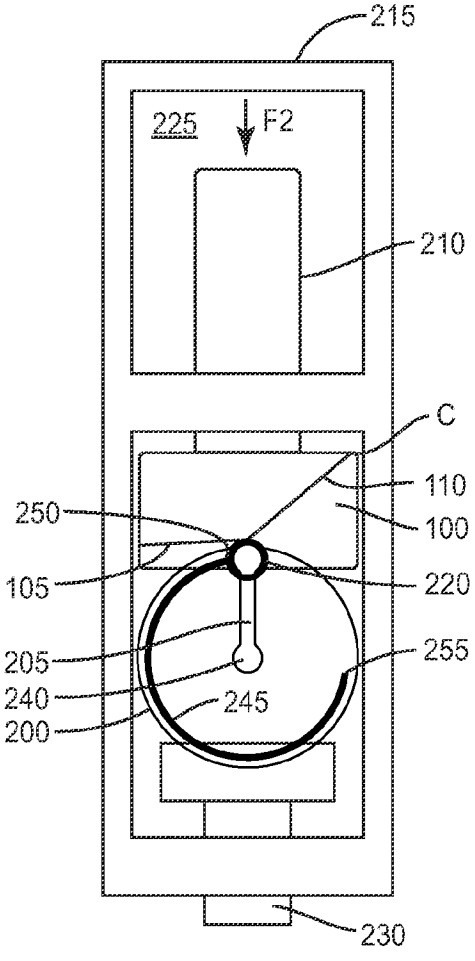
FIGS. 2A through 2E are schematic diagrams illustrating operation of an exemplary impact hammer.
Figure 2B:
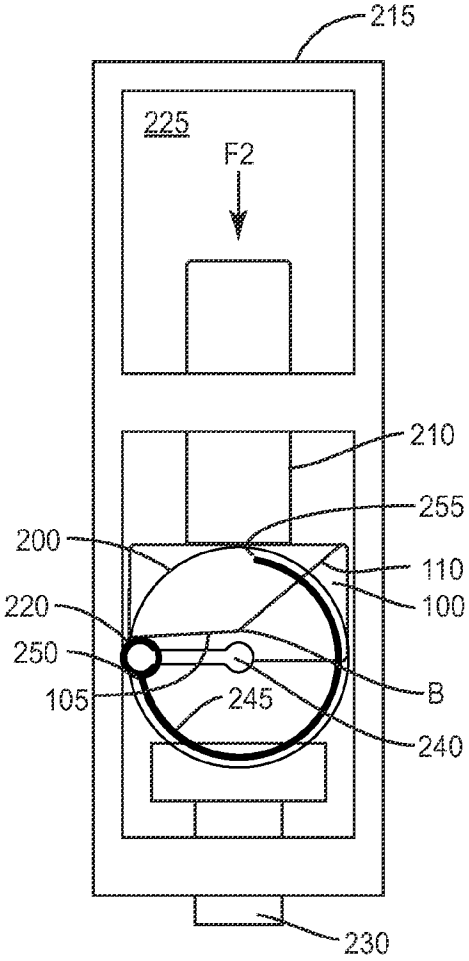
Figure 2A:
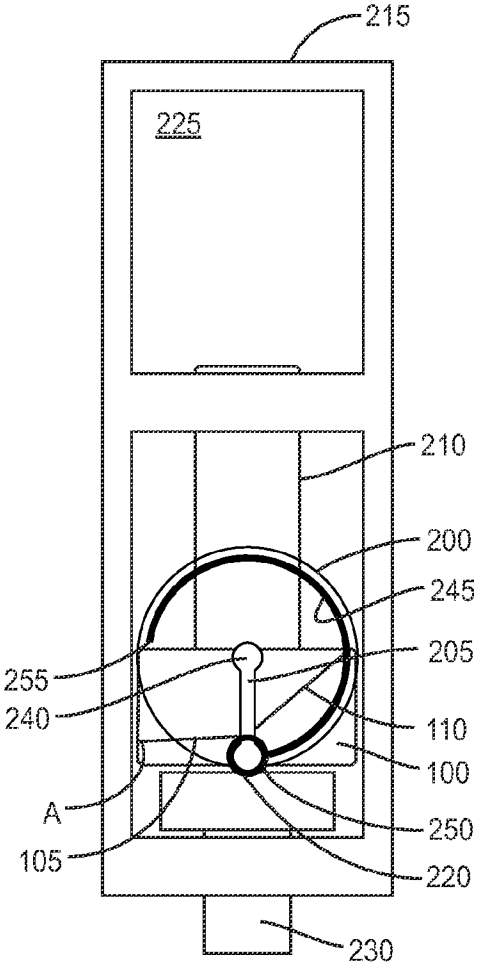

FIG. 2A illustrates the starting point of the cycle of operation according to various embodiments. A secured end 240 of the swing arm 205 is coupled to the spindle 200 such that rotation of the spindle 200 causes a corresponding rotation of the swing arm 205. The secured end 240 may be coupled to the spindle by a bearing 305 (see FIG. 3) that allows the swing arm 205 to freely rotate. The spindle 200 may include a raised inner rim 245 around a portion of the circumference of an inner face 400 (see FIG. 4) of the spindle 200. In FIGS. 2A through 2E, the inner rim 245 is depicted by the semicircular thick black line. Since the inner rim 245 extends only partially around the circumference of the spindle inner face 400 in various embodiments, two ends of the inner rim 245 are exposed, defining a first swing arm stop 250 and a second swing arm stop 255 (see also FIGS. 3 and 4). Opposite the secured end 240 of the swing arm 205 is a free end 235. A contact bushing 220 may be attached to the free end 235 to act as a roller bearing for contact with the contact surface 105 of the anvil 100. At the starting point of the cycle, the swing arm 205 is in a downward position such that the free end 235 of the swing arm is at a lowest position. At this position, the contact bushing 220 may or may not be in contact with the contact surface 105 of the anvil 100. As the spindle 200 begins to rotate, the first swing arm stop 250 may contact the swing arm 205 in proximity to the free end 235. Contact thus made between the first swing arm stop 250 and the swing arm 205, the swing arm 205 begins to rotate with the spindle 200.

In FIG. 2B, the spindle 200 rotates in a clockwise direction causing the swing arm 205 to rotate accordingly. The contact bushing 220 may contact the contact surface 105 in proximity to point A, imparting force F1 (see FIGS. 1A through 1C) on the contact surface 105 causing the anvil 100 to move in an upwards direction along a linear path. The upward movement of the anvil 100 in turn causes the piston 210 to extend into the chamber 225 and compress the energy storage medium. Compression of the energy storage medium imparts a force F2 that urges the piston 210 in a downward direction. In general, force F2 acts in the opposite direction of force F1.

Further rotation of the spindle 200 may cause the swing arm 205 to extend upward as illustrated in FIG. 2C. In this position, the contact bushing 220 is positioned in proximity to point B on the contact surface 105, and the anvil 100 is at a highest position. Similarly, the piston 210 is extended a maximum amount into the chamber 225 and maximum compression of the energy storage medium may be obtained. The force F2 urging the piston 210 downward may also reach a maximum at this point of the cycle.

As the spindle 200 and swing arm 205 continued to rotate, the contact bushing 220 moves beyond point B on the contact surface 105 and begins to approach the ramp off surface 110 of the anvil 100. The ramp off surface 110 is angled in such a way as to urge the contact bushing 220 and the swing arm 205 away from the first swing arm stop 250. At this point, the force F1 exerted by the swing arm 205 approaches zero and force F2 begins to control movement of the piston 210 and anvil 100. Once the contact bushing 220 loses contact with the contact surface 105 as illustrated in FIG. 2D, force F2 is free to act upon the piston 210 and urge the piston 210 and anvil 100 downward. The ramp off surface 110 may also contact the contact bushing 220 and urge the contact bushing 220 further away from the first swing arm stop 250 and closer to the second swing arm stop 255.

Figure 2E:
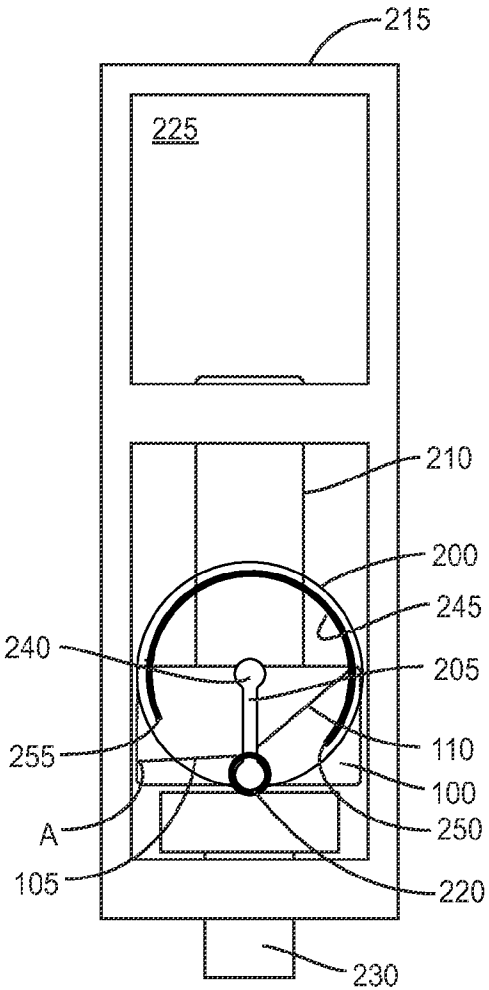
Figure 2D:
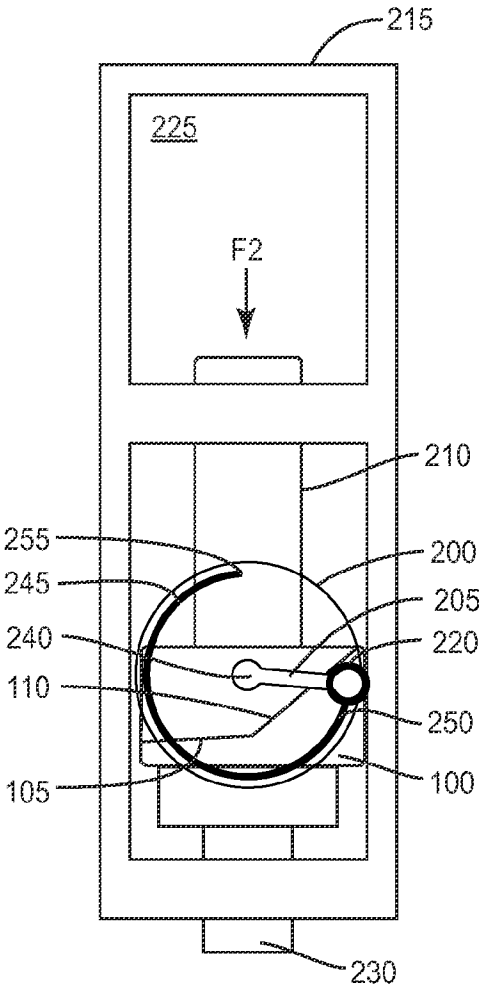

In FIG. 2E, force F2 may no longer be acting upon the piston 210 as at least a portion of the potential energy stored in the energy storage medium has been converted to kinetic energy in the movement of the piston 210 and anvil 100. The anvil 100 may make contact with the work tool 230, transferring at least a portion of the kinetic energy to the work tool 230. The anvil 100, spindle 200, and swing arm 205 may now be back in the starting position of the cycle and may repeat the cycle at FIG. 2A.

While FIGS. 2A through 2E depict clockwise movement of the spindle 200, one skilled in the art would readily envision that counterclockwise movement is within the scope of the present disclosure. For counterclockwise movement, the ramp off surface 110 may be positioned on the left side of the anvil 100 rather than the right side as depicted in FIGS. 2A through 2E. As the anvil 100 rotates counterclockwise, the second swing arm stop 255 may contact the swing arm 205, and the cycle would proceed as described above.

The amount of energy transferred to the work tool 230 is directly related to the force F2 acting upon the piston 210. The magnitude of the force F2 may be related to the amount of work done by the piston 210 on the energy storage medium, as the potential energy stored in the energy storage medium is related to the amount of work done by the piston 210. The amount of work done by the piston 210 is related to at least two factors: a length of the piston 210 and a length of the swing arm 205. The length of the piston 210 may determine how far into the chamber 225 the piston 210 extends, thereby controlling the amount of work done on the energy storage medium. For example, when a spring is used as the energy storage medium, the amount of compression of the spring may determine the magnitude of the force F2 urging the piston 210 downward. Thus, the amount of energy transferred to the work tool 230 may be varied by varying the length of the piston 210. Similarly, the length of the swing arm 205 may determine how far the piston 210 extends into the chamber 225. As can be seen in FIG. 2C, a longer swing arm 205 may move the anvil 100 and piston 210 further upward, and a shorter swing arm 205 may move the anvil 100 and piston 210 a shorter distance upward. Thus, just as varying the length of the piston 210 may vary the magnitude of the force F2, varying the length of the swing arm 205 may also vary the magnitude of the force F2.

Figure 3:
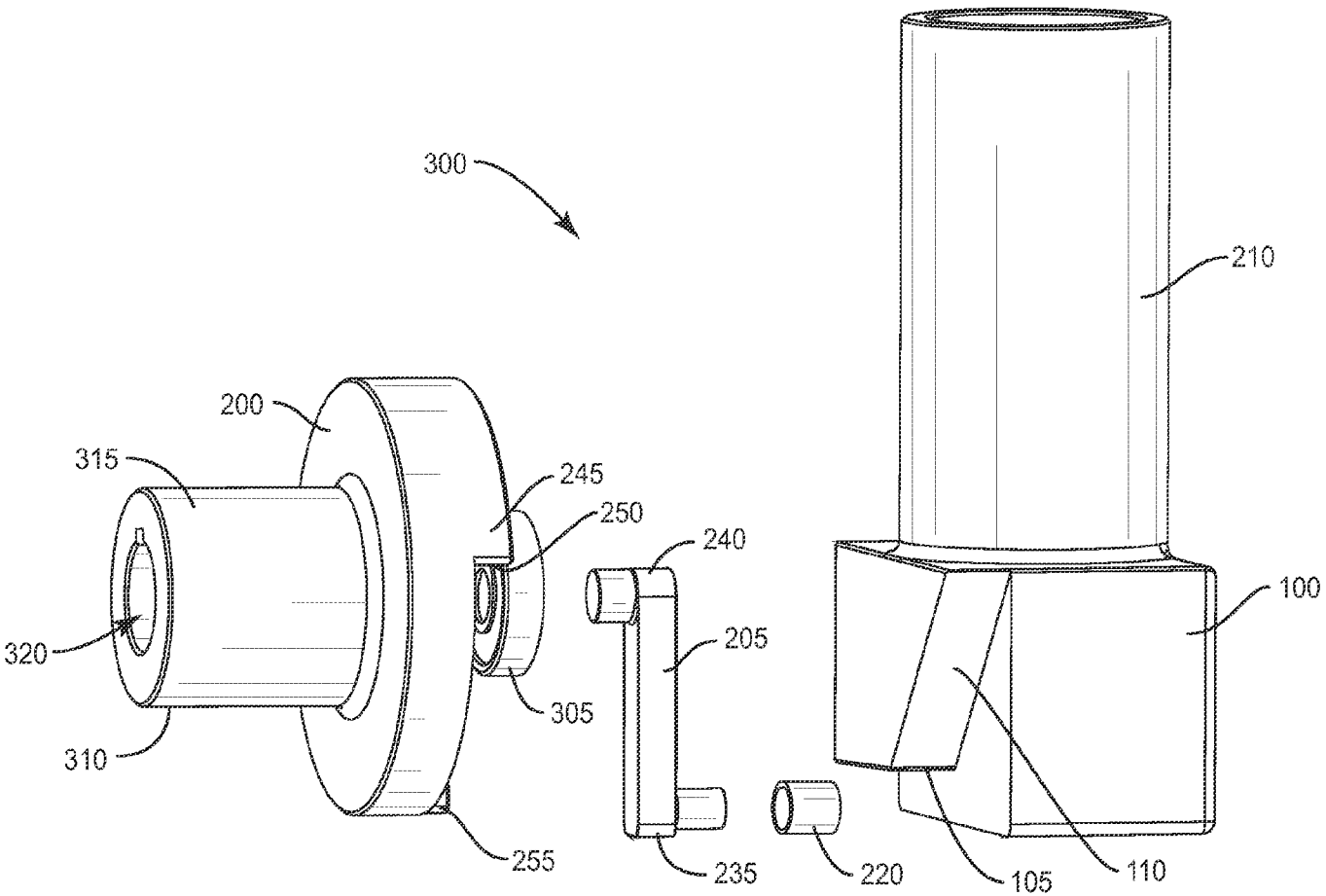
FIG. 3 is an exploded view of an exemplary spindle, swing arm, and anvil.

FIG. 3 illustrates an exploded view of an impactor assembly 300 according to various embodiments as shown schematically in FIGS. 2A through 2E. In this embodiment, the spindle 200 comprises a power transfer member 310 coaxially arranged with the spindle 200. In some embodiments, the power transfer member 310 may be utilized to impart a rotational force on the spindle 200. For example, a belt drive (not shown) may be placed around an outer surface 315 of the power transfer member 310. The belt may be driven by any type of motor or rotational device that causes movement of the belt. Movement of the belt may then cause the spindle 200 and power transfer member 310 to rotate. In other embodiments, a shaft of a motor (not shown) may be directly coupled to the power transfer member 310 via mounting hole 320 or a gear assembly. In still other embodiments, a source of rotational power may be directly coupled to the spindle 200 without the intervening power transfer member 310.

Figure 4:
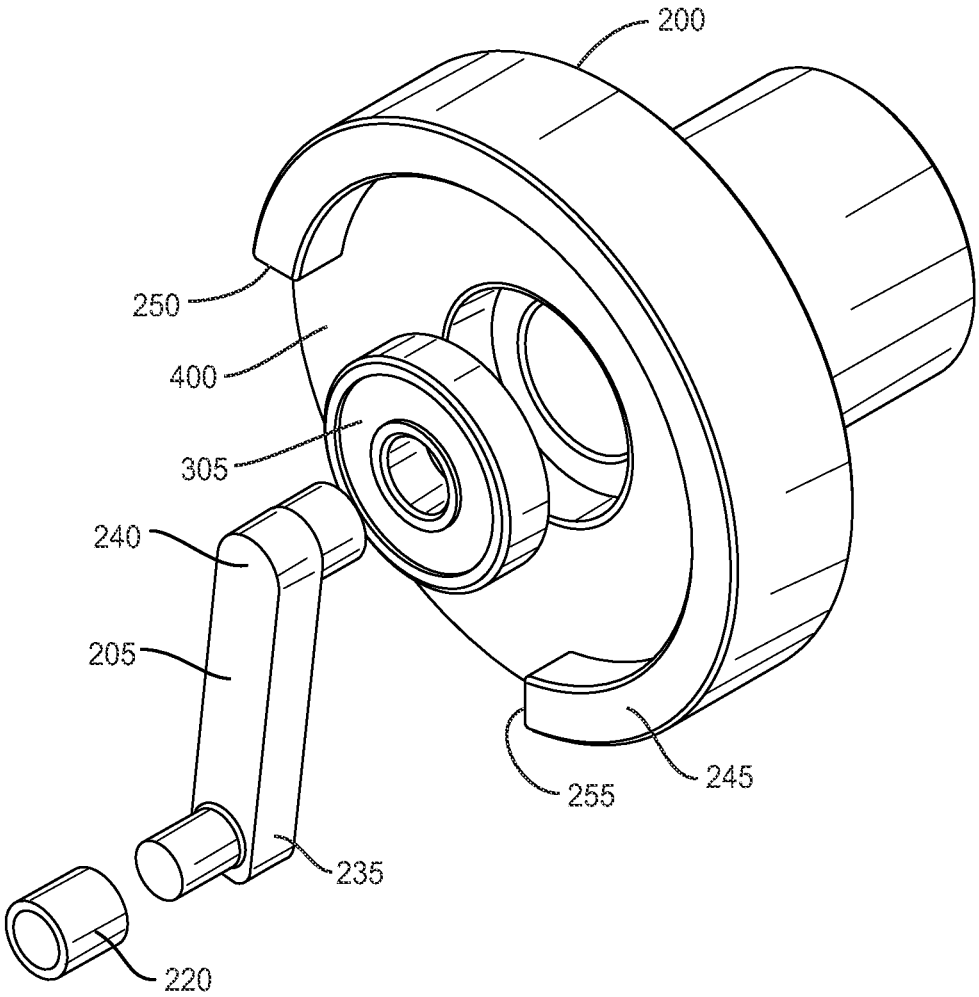
FIG. 4 is an exploded view of an exemplary spindle and swing arm.

FIG. 4 provides an exploded view of the spindle 200 and swing arm 205 portion of the impactor assembly 300 of FIG. 3 according to various embodiments. An inner face 400 of the spindle 200 may be adapted to receive the bearing 305. Referring back to FIG. 3, the inner face 400 of the spindle 200 is disposed toward the anvil 100. The bearing 305, as described above, may be adapted to receive the secured end 240 of the swing arm 205. For the embodiments presented in FIGS. 2A through 2E, the bearing 305 may allow the swing arm 205 to freely rotate from the first swing arm stop 250 to the second swing arm stop 255. In other embodiments, however, the secured end 240 of the swing arm 205 may be fixedly attached to the spindle such that the swing arm 205 is not free to rotate.

Figure 5:
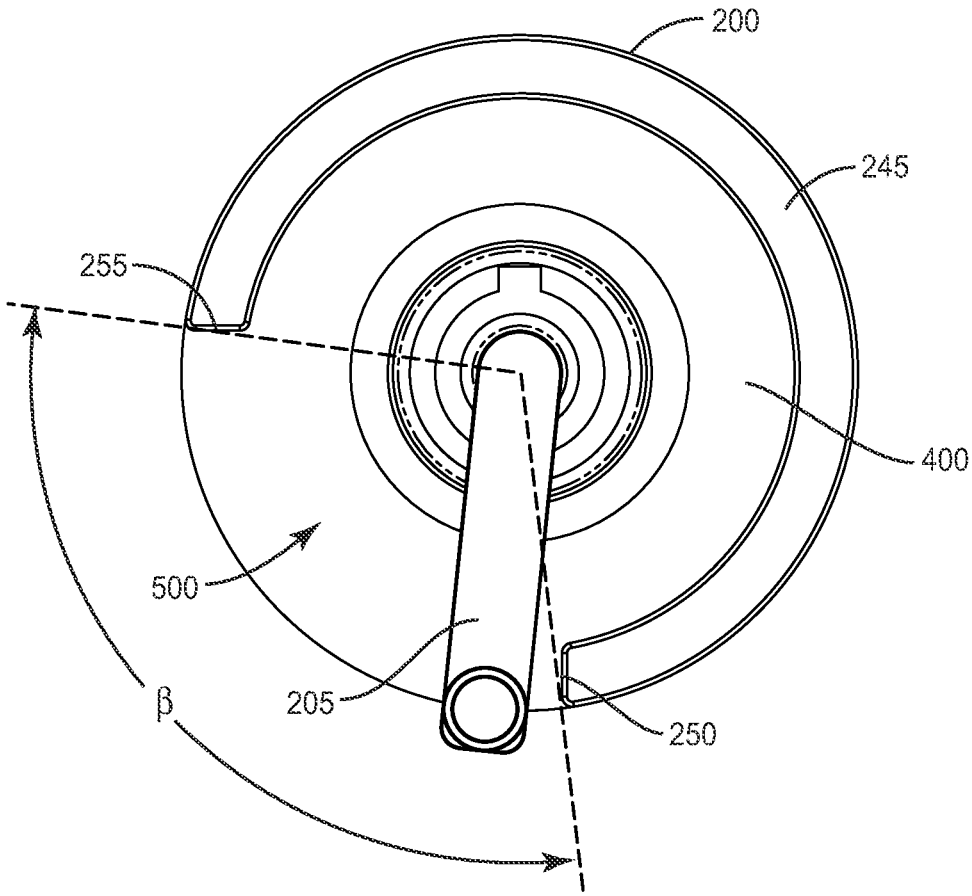
FIG. 5 is a front view of an exemplary spindle and swing arm.

A front view of the spindle is presented in FIG. 5 according to various embodiments. An angle β defined by a center of the spindle 200, the first swing arm stop 250, and the second swing arm stop 255 describes an opening 500 for the free movement of the swing arm 205. The angle β may range from a value such that the opening 500 just allows an interference fit of the swing arm 205 up to about 180° while for other embodiments the opening 500 ranges from about 90° to about 180°. In other embodiments (not shown), the first swing arm stop 250 and the second swing arm stop 255 each comprise a separate post or leg structure extending outward from the spindle inner face 400.

Figure 6:
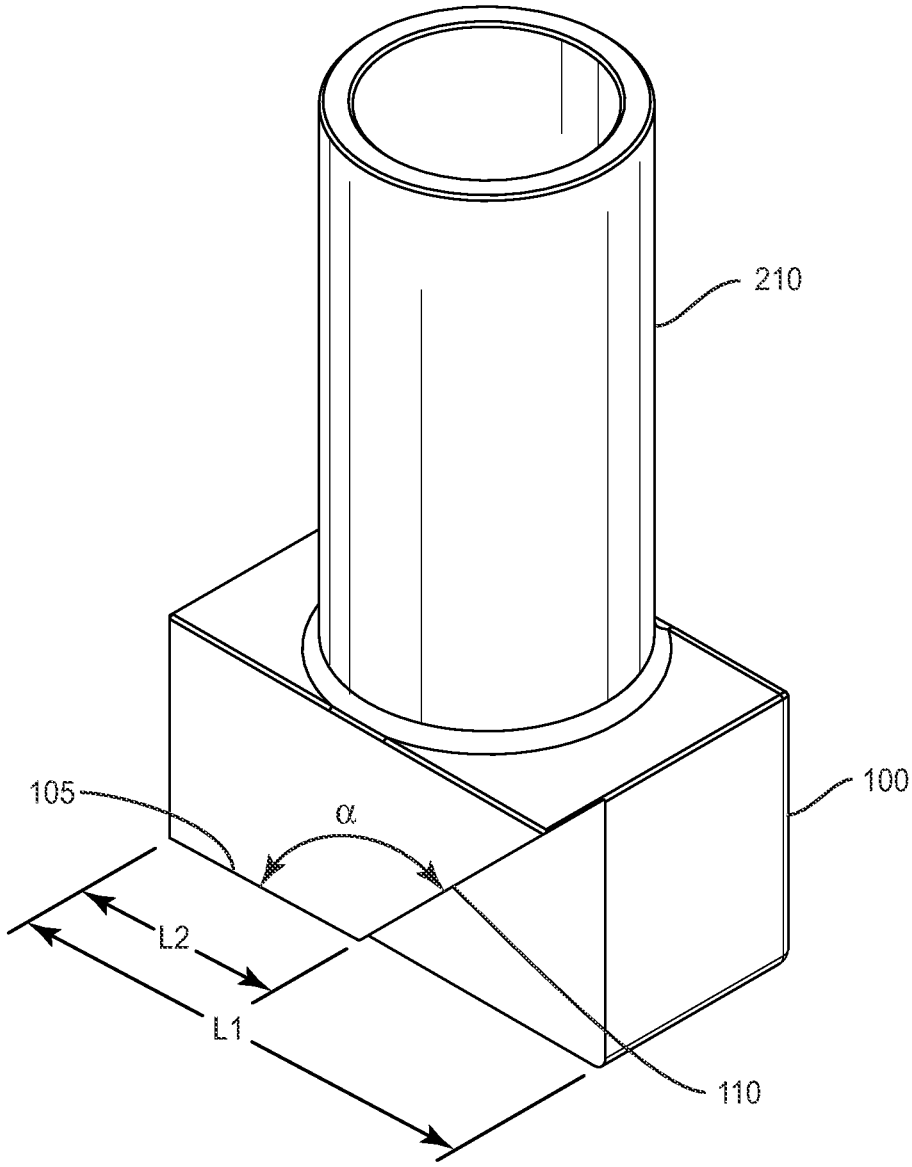
FIG. 6 is an isometric view of an exemplary anvil and piston.

FIG. 6 presents an isometric view of the anvil 100 and piston 210. In various embodiments, the piston 210 may be cylindrical as shown in FIG. 6, or the piston 210 may be oval, rectangular, triangular, or any other regular or irregular geometric shape necessary for a particular function. Likewise, the anvil 100 may take any shape necessary for its function. A length L2 of the contact surface 105 may be approximately half of a length L1 of the anvil 100. In various embodiments as illustrated in FIG. 6, the contact surface 105 and the ramp off surface 110 intersect. The angle α formed by the intersection of the contact surface 105 and the ramp off surface 110 may range from about 45 degrees to about 150 degrees. In various other embodiments (not shown), the contact surface 105 and the ramp off surface 110 may not intersect.

Figure 7A:
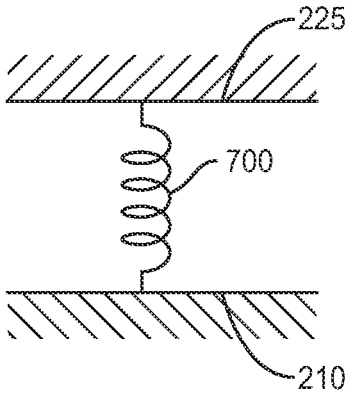
FIGS. 7A through 7E are schematic diagrams of exemplary energy storage media.
Figure 7B:
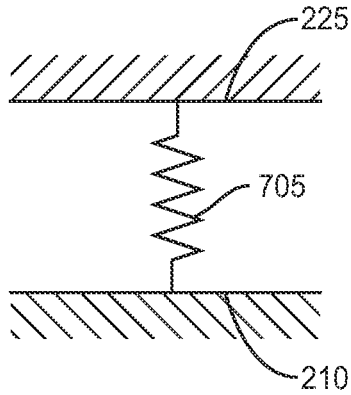
Figure 7C:
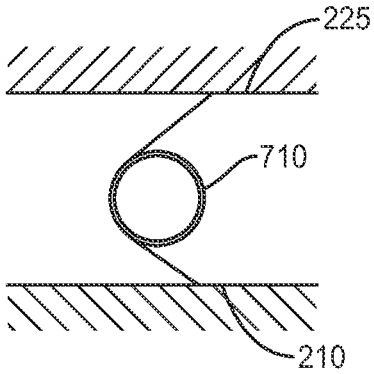
Figure 7D:
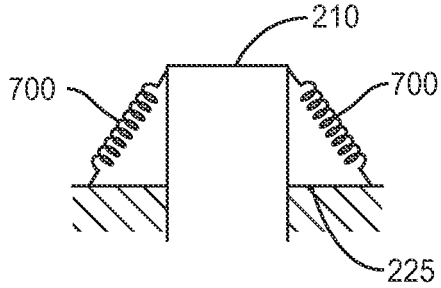
Figure 7E:
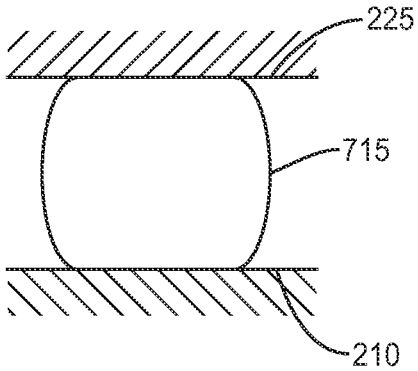

As described previously for FIGS. 2A through 2E, the housing 215 may comprise a chamber 225 for the energy storage medium. The energy storage medium may be any fluid or device capable of resiliently storing and releasing energy. In certain embodiments, the energy storage medium is a gas that is compressed when the piston 210 enters the chamber 225. The compressed gas exerts a force F2 on the piston 210. In other embodiments, the energy storage medium is a mechanical device, such as a helical or coil spring 700 (FIG. 7A), a leaf spring 705 (FIG. 7B), a torsion spring 710 (FIG. 7C), or any other type of spring known in the art. While FIGS. 7A through 7C illustrate embodiments in which the springs 700, 705, 710 are in compression, FIG. 7D illustrates an embodiment where coil springs 700 are in tension. In addition to mechanical springs, a gas-filled bladder 715 (FIG. 7E) may be used as the energy storage medium. The energy storage media illustrated in FIGS. 7A through 7D are meant to be illustrative and are not intended to limit the scope of the present disclosure.

The simple structure of the embodiments disclosed leads to a highly energy efficient mechanism compared to other devices that perform similar functions. For example, a typical 90 pound pneumatic jackhammer requires a compressor to provide compressed air to power the device. Operation of the compressor for a typical work day consumes approximately 22 gallons of diesel fuel to run a 50 horsepower diesel internal combustion engine. Embodiments of the present disclosure that may provide equivalent performance to the 90 pound jackhammer may be operated by a 1 horsepower gasoline internal combustion engine that consumes 1 quart of gasoline for the same work day period. This results in significant energy savings and reduced air emissions, including reduced greenhouse gases.

The United States Environmental Protection Agency (EPA) publishes a variety of emissions factors for use in estimating emissions from many industrial emission sources. One of the most widely use and highly respected publications is AP-42, Fifth Edition, *Compilation of Air Pollutant Emission Factors, Volume* 1*: Stationary Point and Area Sources*. Chapter 3.3 of AP-42 provides emission factors for diesel and gasoline internal combustion engines, which are reproduced in the table below. These emission factors may be used to determine the air emissions from running a standard pneumatic jackhammer and the air emissions from running embodiments of the present disclosure. Comparison of these emissions will allow an estimate of the air emission reductions that may be achievable with embodiments of the present disclosure. The AP-42 emission factors are in terms of lb emitted/million Btu (MMBtu) fuel input. Therefore, the MMBtu fuel input must first be calculated. According to Appendix A of AP-42, the heat content of diesel fuel is 0.137 MMBtu/gal, and gasoline is 0.130 MMBtu/gal. Assuming that each device operates 250 days per year the annual fuel input values are:

0.137 MMbtu/gal×22 gal/day×250 days/yr=753.5 MMBtu/yr (diesel)

0.130 MMBtu/gal×2.0 gal/day×250 days/yr=65 MMBtu/yr (gasoline)

The following table provides the diesel and gasoline emission factors from AP-42, annual emissions for each pollutant for diesel and gasoline, and the annual emission reductions for using embodiments of the present disclosure versus a standard pneumatic jackhammer utilizing a diesel-powered compressor.

TABLE 1

Diesel and Gasoline Emission Factors and Annual Emissions

| Pollutant | Diesel Emission Factor lb/MMBtu | Diesel Emissions lb/yr | Gasoline Emission Factor lb/MMBtu | Gasoline Emissions lb/yr | Emission Reduction lb/yr |
|---|---|---|---|---|---|
| $NO_x$ | 4.41 | 3,323 | 1.63 | 105 | 3,218 |
| CO | 0.95 | 716 | 0.99 | 64 | 652 |
| $SO_x$ | 0.29 | 219 | 0.084 | 5 | 214 |
| PM10 | 0.31 | 234 | 0.10 | 6.5 | 227.5 |
| $CO_2$ | 164 | 123,574 | 154 | 10,010 | 113,564 |
| Aldehydes | 0.07 | 53 | 0.07 | 4.5 | 48.5 |
| TOC | 0.36 | 271 | 3.03 | 197 | 74 |

Table 1 demonstrates a significant and quantitative emission reduction of about 92 percent for each pollutant through the use of embodiments of the present disclosure over the use of standard pneumatic jackhammers. For example, each jackhammer that is replaced with an embodiment of the present disclosure may reduce emissions of nitrogen oxides ($NO_x$) by more than 1.5 tons per year and reduce emissions of the greenhouse gas carbon dioxide ($CO_2$) by more than 56.7 tons per year. Considering the total number of jackhammers and other devices just in the United States that could be replaced by embodiments of the present disclosure, the potential emission reductions are tremendous.

In addition to the emissions reductions detailed above, there are significant energy savings and further emissions reductions due to the decrease in petroleum products consumed. As stated above, the compressor for a standard pneumatic jackhammer consumes about 22 gallons of diesel fuel per day, compared to about 2.0 gallons of gasoline per day for embodiments of the present disclosure.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise.

The above description is illustrative and not restrictive. Many variations of the invention will become apparent to those of skill in the art upon review of this disclosure. The scope of the invention should, therefore, be determined not with reference to the above description, but instead should be determined with reference to the appended claims along with their full scope of equivalents.

What is claimed is:

1. An impact hammer, comprising:

a spindle adapted for rotational movement;

a swing arm comprising a first end and a second end, the second end opposite the first end, the first end rotatably coupled to the spindle such that the rotational motion of the spindle is transferred to the swing arm, the swing arm further comprising a contact bushing extending essentially perpendicularly from the second end of the swing arm into a linear path of an anvil;

the anvil comprising a contact surface adapted to contact the swing arm such that rotation of the swing arm causes the anvil to move in a first direction along the linear path; and a piston operatively coupled to the anvil to follow the linear movement of the anvil, the piston adapted to interact with an energy storage medium when the swing arm moves the anvil in the first direction, thereby causing energy to be stored in the energy storage medium;

wherein continued rotation of the swing arm causes the swing arm to lose contact with the contact surface, thus allowing the energy storage medium to urge a cylinder and the anvil in a second direction opposite the first direction.

2. The impact hammer of claim 1, wherein the spindle further comprises:

an inner face disposed toward the anvil; and a rim radially disposed about a portion of the circumference of the inner face, a first end of the rim defining a first swing arm stop, and a second end of the rim defining a second swing arm stop;

wherein the first swing arm stop is adapted to contact the swing arm when the spindle rotates causing the swing arm to contact the anvil contact surface, and the second swing arm stop is radially disposed about the circumference of the inner face from the first swing arm stop to allow free movement of the swing arm when the anvil moves in the second direction.

3. The impact hammer of claim 2, wherein the first and second ends of the rim define an opening therebetween, the opening and a center of the spindle defining an angle ranging from about 90 degrees to about 180 degrees.

4. The impact hammer of claim 2, wherein the spindle is configured to allow the swing arm to rotate freely in the first direction and to restrict movement of the swing arm in the second direction.

5. The impact hammer of claim 1, wherein the anvil further comprises a ramp off surface angularly disposed to the contact surface and adapted to complement free rotation of the swing arm and to allow free movement of the anvil in the second direction.

6. The impact hammer of claim 5, wherein the contact surface and the ramp off surface intersect at an angle ranging from 45 degrees to about 150 degrees.

7. The impact hammer of claim 5, further comprising a housing, the anvil disposed at least partially within the housing, the ramp off surface defining a gap between the ramp off surface and the housing, the gap adapted to receive at least a portion of the swing arm when the anvil moves in the second direction.

8. The impact hammer of claim 1, further comprising a work tool oriented within the linear path of the anvil such that the anvil makes contact with the work tool when the anvil moves in the second direction.

9. The impact hammer of claim 1, wherein the energy storage medium is a gas confined in a chamber, the chamber adapted to allow the piston to compress the gas.

10. The impact hammer of claim 1, wherein the energy storage medium is a spring adapted to be put into compression or tension when acted upon by the piston.

11. The impact hammer of claim 1, wherein the anvil and the piston are fixedly attached.

12. An impact hammer, comprising:

a spindle adapted for rotational movement;

a swing arm comprising:

a first end and a second end, the first end opposite the second end, the first end rotatably coupled to the spindle such that the rotational motion of the spindle is transferred to the swing arm, the swing arm further comprising a contact bushing extending essentially perpendicularly from the second end of the swing arm into a linear path of an anvil;

the anvil comprising:

a contact surface adapted to contact the swing arm such that rotation of the swing arm causes linear movement of the anvil in a first direction; and a ramp off surface angularly disposed to the contact surface and defining a gap between the ramp off surface and a housing, the gap adapted to receive at least a portion of the swing arm; and a piston operatively coupled to the anvil to follow the linear movement of the anvil, the piston adapted to interact with an energy storage medium when the swing arm moves the anvil in the first direction, thereby causing energy to be stored in the energy storage medium;

wherein continued rotation of the swing arm causes the swing arm to lose contact with the contact surface, thus allowing the energy storage medium to urge the piston and the anvil in a second direction opposite the first direction.

13. The impact hammer of claim 12, wherein the spindle further comprises:

an inner face disposed toward the anvil and oriented essentially perpendicular to the contact surface;

at least one stop extending from the inner face and adapted to contact the swing arm when the spindle rotates.

14. The impact hammer of claim 12, wherein the at least a portion of the swing arm is positioned in the gap when the anvil moves in the second direction.

15. The impact hammer of claim 12, wherein the energy storage medium is a gas confined in a chamber, the chamber adapted to allow the piston to compress the gas.

16. The impact hammer of claim 12, wherein a connection between the swing arm and the spindle allows the swing arm to rotate independent of the spindle when the anvil moves in the second direction.

17. A device for saving energy by reducing the power requirements of an impact hammer, the device comprising:

a spindle adapted for rotational movement, the spindle comprising:

an inner face; and a rim radially disposed about a portion of the circumference of the inner face, one end of the rim defining a first stop, and a second end of the rim defining a second stop;

a swing arm positioned within a rotational path of the first stop and second stop such that one of the first stop or second stop contacts the swing arm when the spindle rotates, the swing arm comprising a first end and a second end, the first end opposite the second end, the first end rotatably coupled to the spindle, the swing arm further comprising a contact bushing extending essentially perpendicularly from the second end of the swing arm into a linear path of an anvil;

the anvil comprising a contact surface adapted to contact the swing arm such that rotation of the swing arm causes linear movement of the anvil in a first direction; and a piston operatively coupled to the anvil to follow the linear movement of the anvil, the piston adapted to interact with an energy storage medium when the swing arm moves the anvil in the first direction, thereby causing energy to be stored in the energy storage medium;

wherein continued rotation of the swing arm causes the swing arm to lose contact with the contact surface, thus allowing the energy storage medium to urge a cylinder and the anvil in a second direction opposite the first direction.

18. The device of claim 17, wherein the energy savings is at least 75 percent.

19. The device of claim 17, wherein the anvil further comprises a ramp off surface angularly disposed to the contact surface and adapted to complement free rotation of the swing arm and to allow free movement of the anvil in the second direction.

20. The device of claim 19, wherein the contact surface and the ramp off surface intersect at an angle ranging from 45 degrees to about 150 degrees.

* * * * *

UNITED STATES PATENT AND TRADEMARK OFFICE

CERTIFICATE OF CORRECTION

PATENT NO. : 8,657,028 B2
APPLICATION NO. : 13/223009
DATED : February 25, 2014
INVENTOR(S) : Raymond Stoner et al.

It is certified that error appears in the above-identified patent and that said Letters Patent is hereby corrected as shown below:

In the specification

In column 3, line 17, delete the text "negative x-direction" and insert the text --negative y-direction--.

Signed and Sealed this
Twenty-second Day of March, 2016

Michelle K. Lee

Michelle K. Lee
*Director of the United States Patent and Trademark Office*